US006237502B1

(12) United States Patent
Van Damme

(10) Patent No.: US 6,237,502 B1
(45) Date of Patent: May 29, 2001

(54) SHEAVE ARRANGEMENT SUITABLE FOR SLACK PULLING CARRIAGE

(76) Inventor: Richard Van Damme, 26841 Doble, Eugene, OR (US) 97402

( * ) Notice: Subject to any disclaimer, the term of this patent is extended or adjusted under 35 U.S.C. 154(b) by 0 days.

(21) Appl. No.: 09/115,576

(22) Filed: Jul. 14, 1998

(51) Int. Cl.[7] ..... B61B 7/00

(52) U.S. Cl. ..... 104/173.1; 104/178; 104/183; 104/230; 104/232; 254/333; 254/374

(58) Field of Search ..... 104/173.1, 173.2, 104/178, 183, 184, 186, 189, 191, 197, 229, 230, 231, 232, 233, 234; 212/110, 99, 97; 254/333, 374

(56) References Cited

U.S. PATENT DOCUMENTS 2,359,073 * 9/1944 Allard ..... 254/333
2,919,015 * 12/1959 Turecheck ..... 254/333
4,005,852 * 2/1977 Schmitmeyer et al. ..... 254/374
4,706,940 * 11/1987 Harig ..... 254/333
5,020,443 * 6/1991 Gauthier ..... 104/230
5,129,626 * 7/1992 Koludzki ..... 254/333
5,975,319 * 11/1999 Carlile ..... 212/99

* cited by examiner

*Primary Examiner*—Mark T. Le
(74) *Attorney, Agent, or Firm*—Steven J. Adamson

(57) ABSTRACT

A sheave arrangement having a driving drum and a tension wheel. The driving drum includes a circumferential groove that has two side walls disposed at an angle, alpha. A line preferably is placed between the drum and tension wheel such that a substantially non-distorting three contact point driving force is achieved. Utilization of this sheave arrangement in a slack pulling carriage and a method of driving a line with the sheave arrangement are also disclosed.

8 Claims, 3 Drawing Sheets

SHEAVE ARRANGEMENT SUITABLE FOR SLACK PULLING CARRIAGE

FIELD OF THE INVENTION

The present invention relates to sheave arrangements and, more specifically, to sheave arrangements that are suitable for use in a slack pulling carriage (SPC).

BACKGROUND OF THE INVENTION

Sheaves and the like are known in the art and may be used to alter the direction of force and/or provide drive to a line, amongst other purposes.

When sheaves are used in a line driving application, there is a constant challenge to achieve desired friction between the drive sheave (often referred to as the "drum") and the line, while not causing undue wear in the sheave or line. Slippage of the line within the sheave results in the consumption of additional energy, wear of components and an increase in fire potential due to sparking, etc.

Known sheave arrangements for slack pulling carriages include those that have a generally U-shaped circumferential groove that approximates the diameter of a line to be used therein and a plurality of weld beads at the bottom or sides of the groove. The weld beads improve friction (or traction) between the drum and the line (like studs on a studded snow tire), but induce wear in the line and sheave at a disadvantageously rapid rate. The undesirable rate of line wear is not only economically disadvantageous in that the line and/or sheave must be replaced, but also raises significant safety concerns.

A need thus exists for a sheave arrangement that provides desired friction without unreasonable wear. This need exists in many driving sheave applications, including but not limited to, slack pulling carriages and related equipment.

SUMMARY OF THE INVENTION

Accordingly, it is an object of the present invention to provide a sheave arrangement for a SPC that achieves desired friction without undesirably inducing wear in a line associated therewith.

It is another object of the present invention to provide such a sheave arrangement that includes a drum and complementary tension wheel.

It is also an object of the present invention to provide a SPC drive sheave arrangement that includes a singular drum that accommodates lines of different size.

These and related objects of the present invention are achieved by use of a sheave arrangement suitable for a slack pulling carriage as disclosed herein.

In one embodiment, the present invention comprises a slack pulling carriage that includes a frame; a drum having a circumferential groove coupled to said frame; a tension wheel provided opposite said drum; and a motor for driving said drum; wherein said groove includes first and second interior side walls and at least a portion of each of said side walls is substantially straight and disposed at an angle, alpha, of approximately 5–100 degrees from the other side wall. A tension wheel is preferably provided opposite the driving drum. At least a portion of the tension wheel and a portion of each of the interior side walls of the drum are preferably configured to apply a substantially non-distorting driving force on a line provided between said drum and said tension wheel. In a further preferred embodiment, the tension wheel and interior side walls of the drum respectively contact a line to be driven at three locations, substantially equilaterally spaced.

In another embodiment, the present invention includes a method of driving a line with such a sheave arrangement.

The attainment of the foregoing and related advantages and features of the invention should be more readily apparent to those skilled in the art, after review of the following more detailed description of the invention taken together with the drawings.

DETAILED DESCRIPTION

Figure 1A:
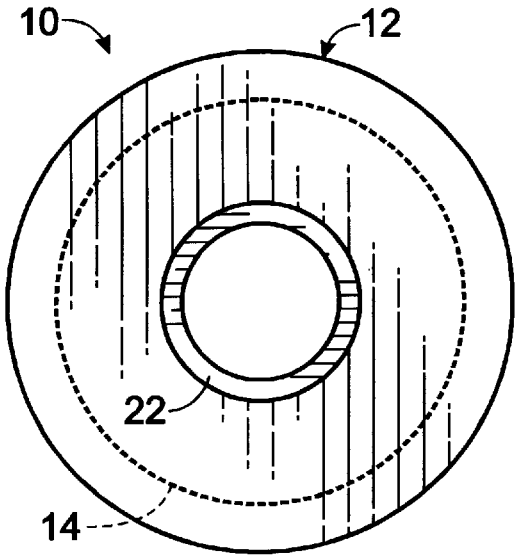
FIGS. 1A–1B are a side view and an edge view of a drum in accordance with the present invention.
Figure 1B:
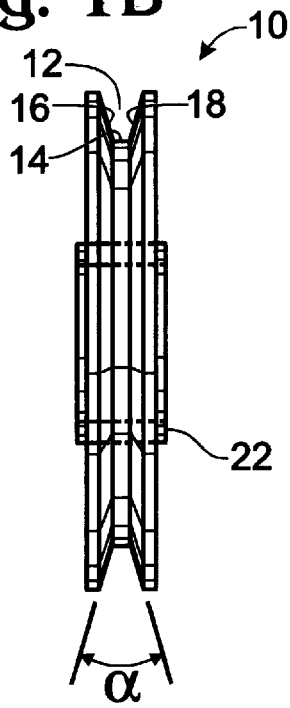

Referring to FIGS. 1A and 1B, a side view and an edge view of a drum 10 in accordance with the present invention are respectively shown. Drum 10 includes a groove 12 that is disposed circumferentially about the drum. The groove has a base 14 and first and second opposing side walls 16,18.

Side wall 16 and 18 are preferably arranged at (or at least have a portion that is arranged at) an angle, $\alpha$, of approximately 5–100 degrees from one another and more preferably at approximately 15–45 degrees and even more preferably at approximately 20–35 degrees. Formation of the groove in this manner achieves several benefits. A first is that a line within the groove contacts both side walls and hence has two contact surfaces with the groove as opposed to only one in a conventional SPC sheave (where the line contacts the base of the groove). The two contact surfaces provide adequate frictional contact and reduced wear, particularly compared to conventional SPC sheaves. Reduced wear is achieved because (1) the two contact surfaces shape a line more uniformly and (2) extraneous friction devices such as weld beads are not required. An additional benefit of the configuration of groove 12 is that it accommodates lines of different size as is discussed in more detail below. Furthermore, as a line wears down the groove, the line simply moves further into the groove, thereby maintaining the beneficial two surface contact and extending the life of the drum.

The surface of side walls 16 and 18 (or at least a portion thereof) is preferably substantially planar or straight and these terms are intended to include surfaces with minor irregularities (e.g., small grooves and/or pits, perhaps formed during the manufacturing process) that still provide a generally flat structure.

Drum 10 preferably contains a hub 22 for mounting to a drum axle. Drive 10 is preferably made of steel and may be formed by casting or by milling and welding hub 22 within the mill product, amongst other techniques.

Figure 2A:
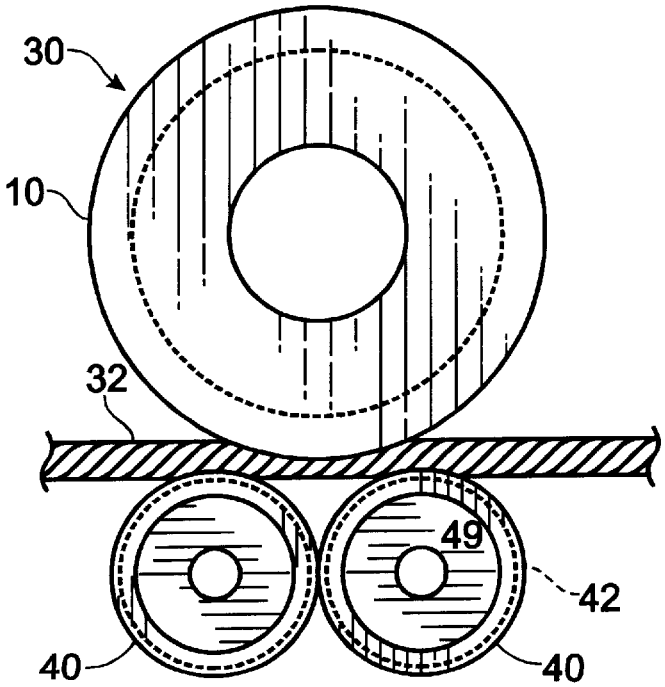
FIGS. 2A–2B are a side view and an edge view of a sheave arrangement that is drawings a line in accordance with the present invention.
Figure 2B:
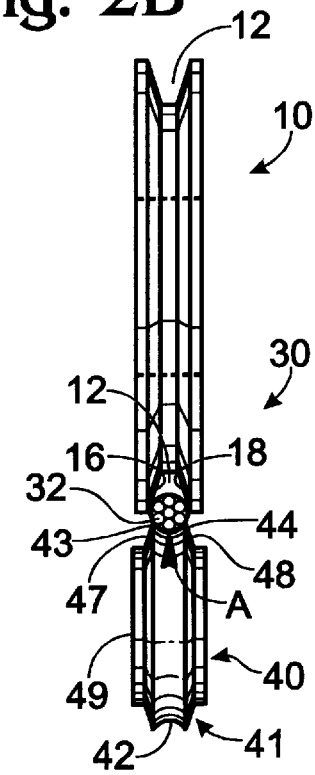

Referring to FIGS. 2A and 2B, a side view and an edge view of a sheave arrangement 30 driving a line in accordance with the present invention are respectively shown. In the arrangement of FIGS. 2A–2B, an exemplary ⅝" line 32 is shown inserted in groove 12 of drum 10. Two tension wheels 40 (only one of which is shown in FIG. 2B) are preferably provided opposite line 32 from drum 10. Tension wheels 40 have a central circumferential protrusion 41. A circumferential recess 42 is preferably provided along the outer edge of this protrusion. The recess is preferably curved and centered and has a radius that is slightly larger than that of the largest line with which it is to be used (though the shape of the recess may become altered with wear). The shape of recess 42 thus tends to conform to that of the line, reducing line distortion. In a preferred embodiment, the tips 43,44 of protrusion 41 are spaced a few thousandths of an inch from the line, assuming a ⅝" line.

The side walls 47,48 of protrusion 41 are preferably tapered back to the center body 49 of wheel 40, generally as shown. The angle of the taper is preferably equal to or less than that of the angled drum side walls 16,18 such that wheel 40 can descend into groove 12 when smaller size lines are used. Also a taper provides more reinforcement for tips 43,44 that would wear more rapidly in the absence of such a taper.

With respect to operation, the provision and configuration of tension wheel 40 provides a third contact surface for line 32. The third contact surface, designated generally by arrowhead A, and the two other contact surfaces are generally arranged in an approximate equilateral triangle to exert a substantially uniform force on the line and thereby minimize line distortion. In the case of a steel fiber line, the line is made of a plurality of small fibers. The exertion of unequal force tends to cause the small fibers to break, which in turn causes damage to human hands that touch the line and premature wear and failure of the line.

Figure 3:
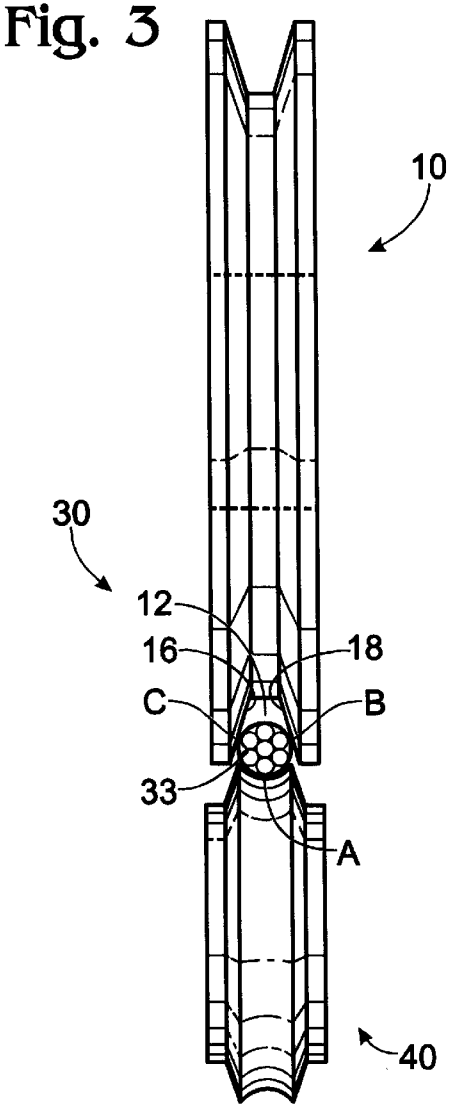
FIG. 3 an edge view of a smaller sized line inserted in the sheave arrangement of FIGS. 2A–2B in accordance with the present invention.

Referring to FIG. 3, an edge view of a smaller sized line inserted in the sheave arrangement 30 of FIGS. 2A–2B in accordance with the present invention is shown. While a ⅝" line 32 was illustrated in the embodiments of FIGS. 2A–2B, a 9/16" line 32 is illustrated in FIG. 3. Drum 10 and tension wheel 40 are as shown in FIGS. 2A–2B. The letters A, B and C indicate the three contact surfaces that securely hold line 33 during driving. Since line 33 is smaller than line 32 (of FIGS. 2A–2B), line 33 descends further into groove 12.

Figure 4:
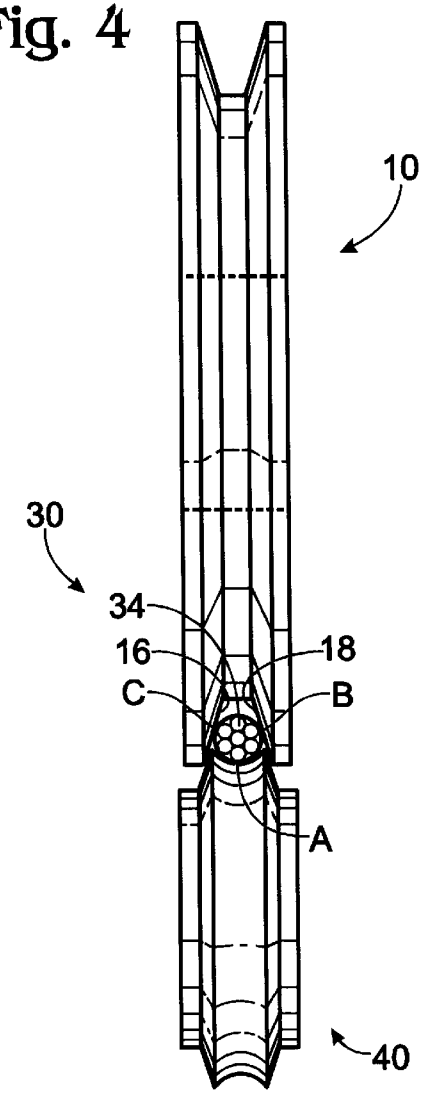
FIG. 4 an edge view of yet a smaller sized line inserted in the sheave arrangement of FIGS. 2A–2B in accordance with the present invention.

Referring to FIG. 4, an edge view of sheave arrangement 30 with yet a smaller line 34 in accordance with the present invention is shown. Line 34 is a ½" line. The three contact surfaces are indicated by letters A, B and C. Line 34 descends further into groove 12 than line 33 (of FIG. 3). The relationship of the three contact surfaces remains fairly constant, however, because of the angle of side walls 16,18. For each of the embodiments disclosed herein, it should be recognized that while the provision of generally equilateral distributed contact surfaces is preferred, non-equilateral arrangements are contemplated by the inventor and intended to be within the present invention.

Figure 5A:
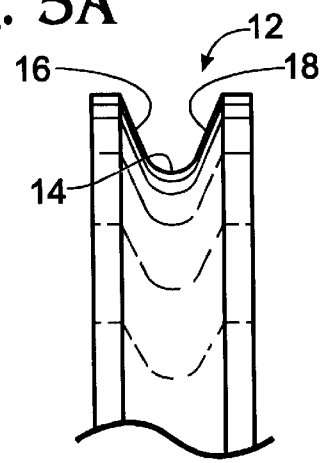
FIGS. 5A–5B are edge views of other groove configurations in accordance with the present invention.
Figure 5B:
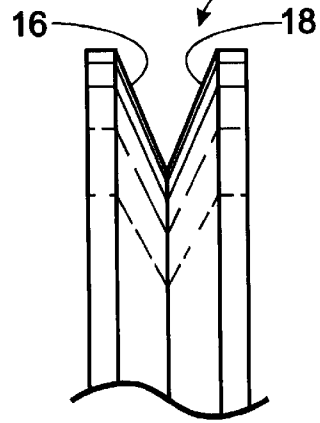

Referring to FIGS. 5A–5B, partial edge views of two other groove configurations in accordance with the present invention are shown. In FIG. 5A, base 14 is curved and side walls 16 and 18 extend therefrom. In FIG. 5B, side walls 16 and 18 intersect, effectively eliminating base 14.

Figure 6:
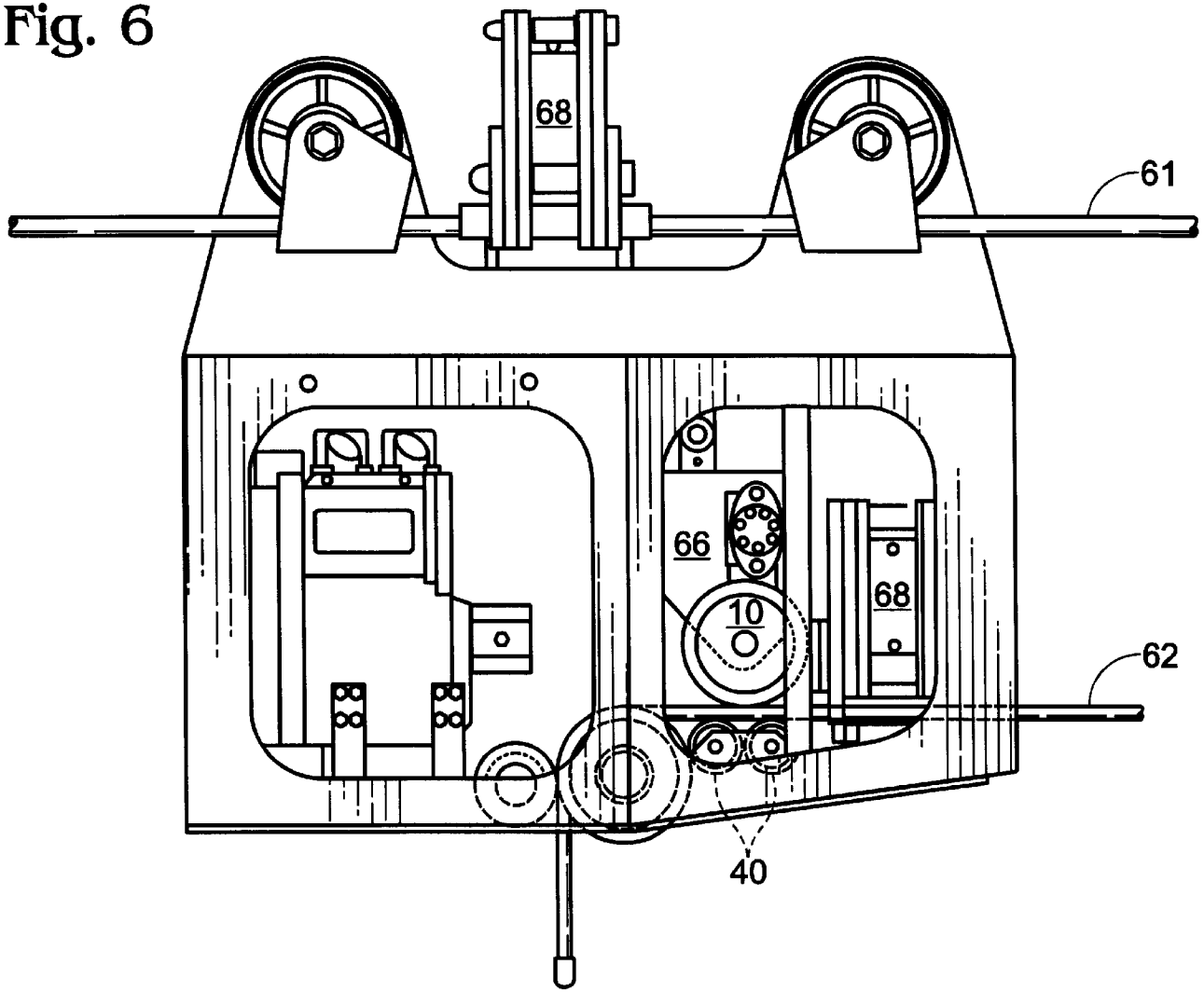
FIG. 6 is a side view of a slack pulling carriage incorporating the sheave arrangement of FIGS. 2A–2B in accordance with the present invention.

Referring to FIG. 6, a side view of a slack pulling carriage 60 in accordance with the present invention is shown. A sky line 61 and a skidding line 62 are fed through the carriage. Drum 10 and tension wheels 40 are provided about skidding line 62 as shown in FIGS. 2A–2B, discussed above. Drum 10 is preferably chain driven by a motor 64 (which may be hydraulic, gas or electric), and both the motor 64 and drum 10 are preferably mounted on drive plate 66. Contact between line 62 and drum 10 is preferably achieved by movement of drum 10 (i.e., plate 66) onto line 62 while the tension wheels remain in a substantially fixed position. Drum 10 is preferably moved because groove 12 is deeper than recess 42, thereby providing better guiding of different sized lines.

The use of sheave arrangement 30 permits carriage 60 to securely engage the skidding line while minimizing wear. Slack pulling carriage 60 also includes other conventional slack pulling carriage components including clamps 68, sky line sheaves 70, line position sheaves 72, a drive mechanism (hydraulic, gas, electric) 74 and a remote control unit (not shown).

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A slack pulling carriage apparatus, comprising;

a frame;

a drum having a circumferential groove coupled to said frame;

a first tension wheel provided opposite said circumferential groove and disposed substantially in the same plane thereof, said tension wheel having a first peripherally disposed contact surface that is configured to contact at least one edge of a lateral cross section of a flexible steel line provided between said drum and said tension wheel, said tension wheel and said drum in combination being arranged to receive and operate with a generally straight portion of that line to be located between the drum and the tension wheel; and a motor for driving said drum;

wherein said groove descends from a periphery of said drum towards the center thereof and includes first and second interior side walls that each have a portion that is substantially planar and disposed substantially symmetrically about a plane perpendicular to the axis of the drum from the other side wall portion, each side wall portion being further disposed at an angle, alpha, of approximately 5–100 degrees from the other side wall portion; and further wherein said side wall portions and said tension wheel are configured and arranged within said slack pulling carriage such that when a flexible steel line is provided therebetween for driving, said first and second side wall portions each contact that line at a distinct location on a lateral cross-sectional edge of that line such that the additional contact from said tension wheel causes that line to be driven in a manner that does not substantially distort the lateral cross-sectional shape of that line.

2. The apparatus of claim 1, further comprising a second tension wheel having a second peripherally disposed contact surface;

said second tension wheel being provided adjacent said first tension wheel such that said second contact surface cooperates with said first contact surface and said drum to apply a substantially non-distorting force on a line provided between said drum and said first and second tension wheels and driven by said drum.

3. The apparatus of claim 1, wherein said first contact surface is formed in a first circumferential protrusion of said first tension wheel that has first and second protrusion side walls that are disposed at an angle relative to one another that is less than alpha such that said protrusion is capable of descending to some extent into said groove.

4. The apparatus of claim 1, wherein said first tension wheel is configured such that contact, between a tension wheel and a line disposed between said drum and said tension wheel and driven by said drum, is made at at least one distinct location about the peripheral edge of a lateral cross-section of that line.

5. The apparatus of claim 4, wherein said first peripheral contact surface is curved and has a radius of curvature that is greater than that of a line with which said tension wheel is designed to be utilized.

6. The sheave arrangement of claim 1, wherein said angle alpha is between 15–45 degrees.

7. The apparatus of claim 4, wherein said first and second side wall portions and said first tension wheel are each configured so as to contact a line provided therebetween for driving in one distinct location along a peripheral edge of a lateral cross-section of that line.

8. The apparatus of claim 7, wherein three distinct contact locations of the first and second side wall portions and the tension wheel, respectively, are substantially equilaterally disposed about that line.

* * * * *